US005316514A

United States Patent [19]

Ellman et al.

[11] Patent Number: 5,316,514

[45] Date of Patent: May 31, 1994

[54] TOY VEHICLE AND LAUNCHER SYSTEM

[75] Inventors: Steven Ellman, Brooklyn; Fredric Ellman, New York; Julius Ellman, Brooklyn, all of N.Y.; John C. Fusi, New Providence, N.J.

[73] Assignee: Matchbox Toys (USA) Ltd., Moonachie, N.J.

[21] Appl. No.: 834,865

[22] Filed: Feb. 13, 1992

[51] Int. Cl.[5] ..... A63H 29/00

[52] U.S. Cl. ..... 446/26; 446/430; 446/464

[58] Field of Search ..... 446/26, 429, 430, 464, 446/462, 457, 63–65

[56] References Cited

U.S. PATENT DOCUMENTS

| | | | |
|---|---|---|---|
| 2,788,613 | 6/1955 | Gelfand et al. | 446/429 |
| 2,803,922 | 8/1957 | Holt | 446/429 |
| 3,693,282 | 9/1972 | Adicks et al. | 446/430 |
| 3,735,526 | 5/1973 | Ensmann | 446/429 |
| 3,878,642 | 4/1975 | Lemelson | 446/176 |
| 3,952,442 | 4/1976 | Livesey et al. | 446/429 |
| 4,413,443 | 11/1983 | Kulesza et al. | 446/26 |
| 4,418,495 | 12/1983 | Kennedy et al. | 446/429 |
| 4,473,969 | 10/1984 | Wilson | 446/26 |
| 4,501,567 | 2/1985 | Cathell | 446/430 |
| 4,529,389 | 7/1985 | Kennedy et al. | 446/26 |
| 4,737,135 | 4/1988 | Johnson et al. | 446/430 |
| 4,756,703 | 7/1988 | Kennedy et al. | 446/26 |
| 5,129,852 | 7/1992 | Crisci et al. | 446/60 |

*Primary Examiner*—Mickey Yu

*Attorney, Agent, or Firm*—Panitch Schwarze Jacobs & Nadel

[57] ABSTRACT

A toy vehicle and launcher system includes a motor-driven toy vehicle having a wind-up spring-driven motor to provide forward motion thereof. The launcher is adapted to mount the vehicle and has a releasable latch for precluding forward motion of the vehicle. A biasing spring provides the vehicle with forward motion immediately upon release of the latch. Preferably, the launcher is configured and dimensioned to be releasably mounted on a human limb so that the longitudinal axis of the vehicle is aligned with the longitudinal axis of the limb, thereby making the launcher a foot-operated or arm-operated launcher.

26 Claims, 6 Drawing Sheets

FIG. 1A
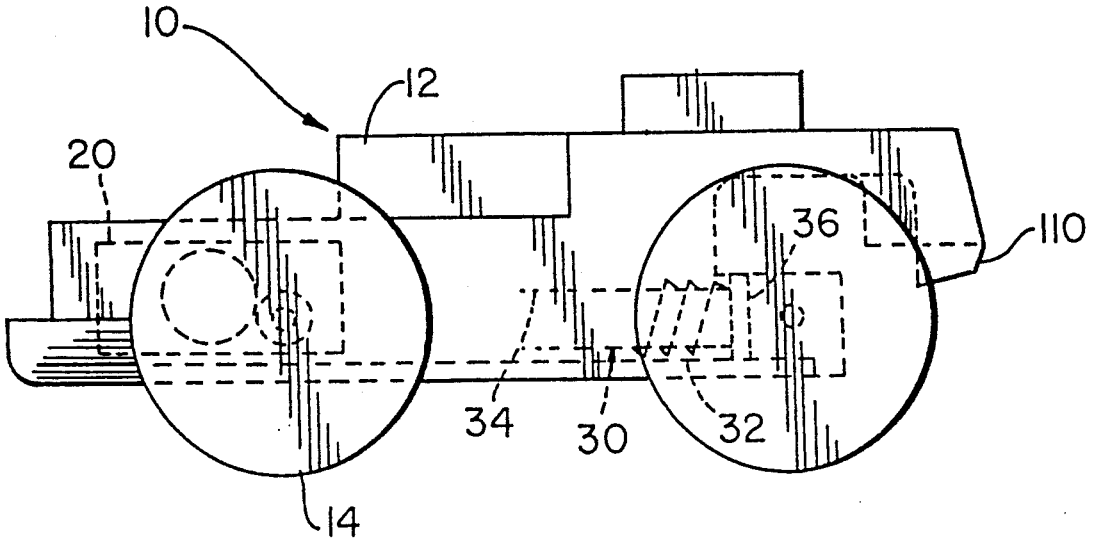
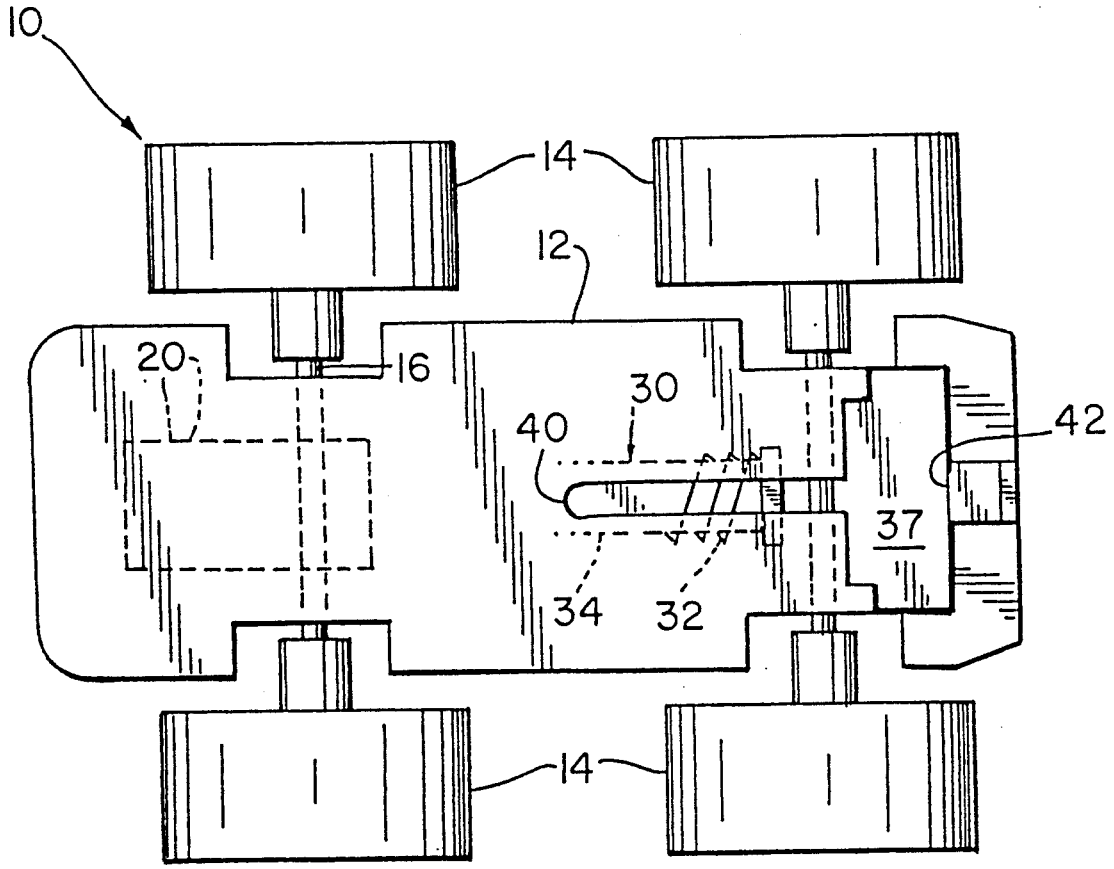
FIG. 1B

TOY VEHICLE AND LAUNCHER SYSTEM

BACKGROUND OF THE INVENTION

The present invention relates to a toy vehicle and launcher system and, more particularly, to such a system wherein the toy vehicle is a miniature racing car or the like.

Toy vehicles such as miniature racing cars, but also including miniature airplanes and the like, have for generations appealed to both children and adults. In some instances, the vehicles are used without any launcher, with the user's hand restraining the vehicle against forward motion relative thereto until the user's hand releases the vehicle. Such a mechanism is essential where the toy vehicle is propelled only by the momentum imparted thereto by the user's hand. On the other hand, where the forward momentum of the toy vehicle is to be provided by means other than the user's hand, the toy vehicle is commonly (although not necessarily) used in combination with a launcher. The vehicle is mounted on the launcher, which has releasable locking means for precluding forward motion of the vehicle until the locking means is released. The present invention is directed to such a toy vehicle and launcher system.

Essentially, there are two types of toy vehicle and launcher systems. In one type, the toy vehicle is motor-driven by means of a wind-up spring-driven motor which provides forward motion for the vehicle. While the motor may have the spring thereof wound directly by means of a key or the like, typically the motor is wound up by moving the vehicle by hand over a surface with the relative motion of the wheels over the surface causing rotation of the wheels and winding up the spring of the motor linked thereto. In some instances the vehicle is moved exclusively in a rearward direction in order to wind the motor, although in other instances the vehicle may be moved both forwardly and backwardly, with both motions acting to wind up the spring of the motor (such a dual-motion motor being available under the trade name DARDA). Preferably a clutch is provided to preclude overwinding of the motor.

In the other type of toy vehicle and launcher system, the launcher is provided with biasing means such as a compression spring, rubber band, or the like, which is stressed and, upon release, imparts forward momentum to the vehicle as the biasing means returns to its unstressed condition. For example, where the biasing means is a compression spring, the compression spring has its rear end fixedly secured to the launcher, and the spring front end is moved toward the spring back end in order to compress and stress the spring so that, upon release thereof, the spring front end moves sharply in the forward direction, thereby imparting forward momentum to the vehicle. Where the biasing means is a rubber band, the forward end of the rubber band is fixedly secured to the launcher, and the band rear end is extended rearwardly relative to the band front end to stress the rubber band by expansion, so that, upon release of the band rear end, the rubber band contracts and the band rear end moves sharply in the forward direction, thereby imparting forward momentum to the vehicle. The stressing of the biasing means may be either directly by the user (for example, the user may compress the spring or extend the rubber band before the vehicle is placed on the launcher), or indirectly using the vehicle where the act of the user in mounting the vehicle on the launcher stresses the biasing means (for example, by the user moving the vehicle rearwardly on the launcher to thereby stress the biasing means).

As is well known to those skilled in the toy vehicle art, the two drive systems—the wind-up motor in the vehicle and the biasing means in the launcher—have different characteristics. The biasing means in the launcher can provide the vehicle with an initial quick acceleration immediately upon release from the launcher. The forward momentum of the biasing means is transferred to the vehicle so that the vehicle is immediately propelled forward with substantial force. However, the velocity of the car in the forward direction peaks shortly after the launching and then gradually diminishes due to frictional effects, wind resistance and the like. In other words, the biasing means in the launcher provides a quick start, but a short run (that is, a short travel by the vehicle). On the other hand, the wind-up motor must overcome the initial stationary momentum of the vehicle, and, in particular the motor parts, before it can "come up to speed." However, depending upon the capacity of the spring in the motor, the motor can continue to provide a force driving the vehicle in the forward direction for a prolonged period after the vehicle has been released from the launcher. Thus the wind-up motor provides a slow start, but a long run. While the characteristics of the systems differ, one providing a quick start and a short run, and the other providing a slow start and a long run, the ideal system would combine a quick start with a long run.

For the most part, the conventional toy vehicle and launcher systems have utilized a launcher adapted to be placed on a floor, table or like flat surface in a stationary position, with the user manually depressing a release mechanism in order to release the locking means and enable forward motion of the vehicle. In such a system, the user is psychologically spaced from the vehicle, and hence from the driver of the vehicle, so that he is less able to identify with and imagine himself to be the driver of the vehicle. There has been a wrist-mounted launcher with the axis of the vehicle being perpendicular to the axis of the wrist (and thus the arm) so that the vehicle, upon release, had a forward direction motion transverse to the wrist; however, it was difficult to "aim" the vehicle in a given direction due to the transverse mounting configuration, and the user's sense of identification with the driver was therefore only minimal. It would be easier to aim the forward motion of the vehicle and promote the sense of identification with the driver if the vehicle had its initial forward motion along or parallel to the axis of the limb so that the vehicle would actually travel over the phalanges of the user.

Accordingly, it is an object of the present invention to provide a toy vehicle and launcher system which combines the advantages of a wind-up motor in the vehicle and a biasing means in the launcher to provide a quick start and a long run for the vehicle.

Another object is to provide a toy vehicle and launcher system wherein the launcher is mounted on a limb of the user so that the initial forward motion of the vehicle is parallel to the axis of the limb.

A further object of the present invention is to provide a toy vehicle having two separate and independent drive means so that it achieves a quick start and a long run.

SUMMARY OF THE INVENTION

The above and related objects of the present invention are found in a toy vehicle having two independent and separate means of propulsion in the forward direction, one of the propulsion means comprising a wind-up spring-driven motor and the other comprising biasing means.

In a preferred embodiment, the biasing means comprises a spring and a retractable spring-loaded piston, the axes of the spring and the piston being longitudinally aligned with the longitudinal axis of the vehicle. The piston is axially aligned with the vehicle and is loaded against the spring by backward motion of the vehicle. Where the vehicle comprises at least a longitudinally spaced pair of wheels, the biasing means is optimally disposed intermediate the pair of wheels. The biasing means provides the vehicle with a maximum forward motion force essentially immediately upon release of the vehicle from a restrained position, and the motor provides the vehicle with an additional maximum forward motion force thereafter.

The present invention also encompasses a toy vehicle and launcher system comprising a toy vehicle and a launcher for mounting the vehicle, the launcher having releasable locking means for precluding forward motion of the vehicle. Biasing means in the vehicle provide the vehicle with forward motion immediately upon release of the locking means, and a wind-up spring-driven motor in the vehicle provides forward motion thereof after such release.

In a preferred embodiment, the biasing means is separate and independent from and in addition to the motor. The biasing means comprises a spring and a retractable spring-loaded piston. The system further includes means for retracting the piston against the spring as the vehicle is mounted on the launcher with a backward motion.

The present invention further encompasses such a toy vehicle and launcher system wherein the launcher is configured and dimensioned to be releasably mounted on a human limb— namely, the hand or foot—so that the longitudinal axis of the vehicle is aligned with the longitudinal axis of the limb.

In a preferred embodiment, the launcher is either a glove-like member configured and dimensioned for mounting the vehicle on a hand or a shoe-like member configured and dimensioned for mounting the vehicle on a foot. The locking means is configured and dimensioned for release by movement of the limb, preferably a lateral movement, a downward movement or both.

Preferably the system additionally includes means for releasing the locking means, the releasing means extending laterally to both sides of the locking means. A pair of release means may be provided for releasing the locking means, each of the releasing means being disposed on an opposite side of the locking means and being capable of releasing the locking means independently of the other of the pair of releasing means.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 1A and 1B are side elevational and bottom plan views, respectively, of a toy vehicle according to the present invention;

DETAILED DESCRIPTION OF THE PREFERRED EMBODIMENTS

Figure 2:
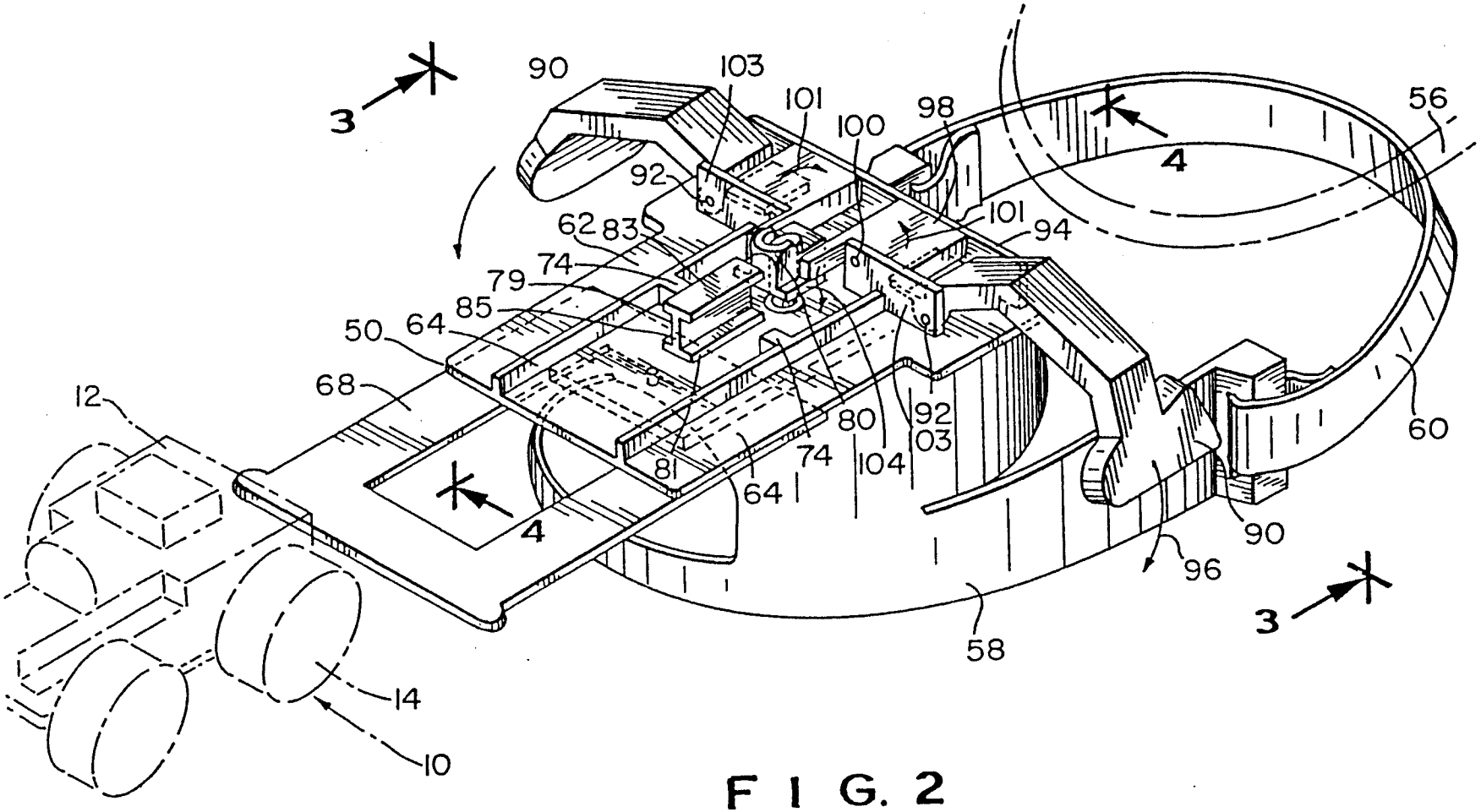
FIG. 2 is an isometric view of a foot-mounted launcher according to the present invention, with the toy vehicle being fragmentarily illustrated in phantom line at the front end thereof and a foot being fragmentarily illustrated in phantom line at the rear end thereof.

Referring now to the drawing, and in particular to FIGS. 1A and 1B thereof, therein illustrated is a toy vehicle according to the present invention, generally designated by the reference numeral 10. The toy vehicle 10 is illustrated as a miniature racing car, but may alternatively be a miniature plane, miniature stock car, or the like. The vehicle 10 has a body or chassis 12, four wheels 14, and two axles 16. The wheels 14 are mounted, two to an axle, for rotation relative to the chassis 12. It will be appreciated that in other embodiments a greater or lesser number of wheels 14 and axles 16 may be employed (for example, when the vehicle is in the form of an airplane, there may be two front wheels mounted on a single axle and only a third wheel in the rear).

A wind-up spring-driven motor 20 is mounted in the chassis 12 to provide forward motion to the vehicle 10. The motor 20 is of conventional design and is preferably a DARDA motor, which is wound up by either forward or rearward motion of the vehicle, or both, although the less expensive motors which are wound up only by motion of the vehicle 10 in one direction (typically the rearward direction) may be used instead. In any case, the motor 20 operatively engages the axle 16 connecting the two front wheels 14 so as to provide a driven rotation of the front wheels 14 to drive the vehicle 10 in the forward direction. If desired for particular applications, the motor 20 may be secured to the axle 16 connecting the rear wheels 14 instead of or in addition to the axle 16 connecting the front wheels 14. Preferably, the motor 20 is of the type which, once it winds down, disengages from the axle 16 so as to enable free rotation of the axle (without exerting any drag force thereon) so that the run of the vehicle is extended beyond the time during which the motor 20 is actually driving the vehicle 10. As the chassis 12, wheels 14, axle 16, motor 20 and their interconnections are well known in the toy vehicle art, further details thereof will be readily appreciated by those skilled in the art and need not be set forth herein.

Biasing means generally designated 30 are disposed in the vehicle 10 to initially provide forward motion to the vehicle 10. The biasing means 30 is separate and independent from, and in addition to, the motor 20. The biasing means 30 comprises a linear coil spring 32 (such as a compression spring) and a piston 34 which is retractable against the influence of the spring 32. The axes of the spring 32 and the piston 34 are longitudinally aligned with the longitudinal axis of the vehicle 10. In FIG. 1, the vehicle 10 is shown as having a longitudinally spaced pair of wheel sets (i.e., a front wheel set and a rear wheel set), with the biasing means 30 being disposed intermediate the two sets. However, since the biasing means 30 is not functionally engaged with any of the wheels 14 or axles 16, it may in fact be disposed anywhere in the chassis 12, provided that there is some means for loading the piston 34 against the spring 32. As illustrated, the spring 32 has its forward end fixed to the chassis 12 and its rear end bearing against the enlarged head 36 of the piston 34 at the rear end thereof. The bottom of the chassis 12 defines a slot 40 which enables a member (not shown in FIGS. 1A or 1B) to be inserted into the slot 40 and used to move the piston head 36 forwardly relative to chassis 12, thereby to load the piston 34 against the compressed spring 32, either by backward motion of the vehicle 10 relative to the member or a forward motion of the member relative to the vehicle 10. The member does not extend upwardly as far as the axle 16 so that, upon release of the vehicle 10, as the vehicle is propelled in the forward direction, the axle 16 can pass over the member without interference from that member.

If desired for particular applications, especially for use of the vehicle in the absence of a launcher, the piston head 36 may project outwardly from the rear of the chassis 12 so that the piston 34 may be loaded against the spring 32 simply by backing the vehicle 10 against a stationary surface contacted by the piston head 36. In this instance, the chassis slot 40 may be dispensed with, but care must be taken to ensure that the center of gravity of the vehicle is not adversely affected.

The chassis 12 defines an abutment surface 42 which is available for engagement by the locking means of the launcher to restrain the vehicle from forward motion until the locking means is released—for example, by being depressed below the level of the abutment surface 42.

It will be appreciated that the toy vehicle 10 according to the present invention is capable of a quick start and a long run because the biasing means 30 provides the vehicle with a maximum forward motion force essentially immediately upon release of the vehicle from its restrained position, and the motor 20 provides the vehicle with an additional maximum forward motion force thereafter once the motor has "come up to speed." The provision within the vehicle 10 of two independent and separate means of propulsion in the forward direction—one propulsion means comprising the wind-up spring-driven motor 20 and the other comprising the biasing means 30—runs counter to the practice of the industry, which is to generally minimize the weight of the vehicle 10 and thus its inertia. However, the provision of the lightweight metal compression spring 32 and a lightweight plastic piston 34 does not greatly contribute to the weight and inertia of the vehicle, yet at the same time provides the desirable quick start. And where the biasing means 30 is disposed not in the vehicle 10, but rather in the launcher used in association therewith, the weight of the biasing means 30 does not increase the weight of the vehicle at all.

The vehicle 10 described above may be used in conjunction with a conventional launcher (not shown) having releasable locking means for precluding forward motion of the vehicle mounted thereon. Such launchers are well known in the toy vehicle art and hence need not be described herein in further detail.

Figure 3:
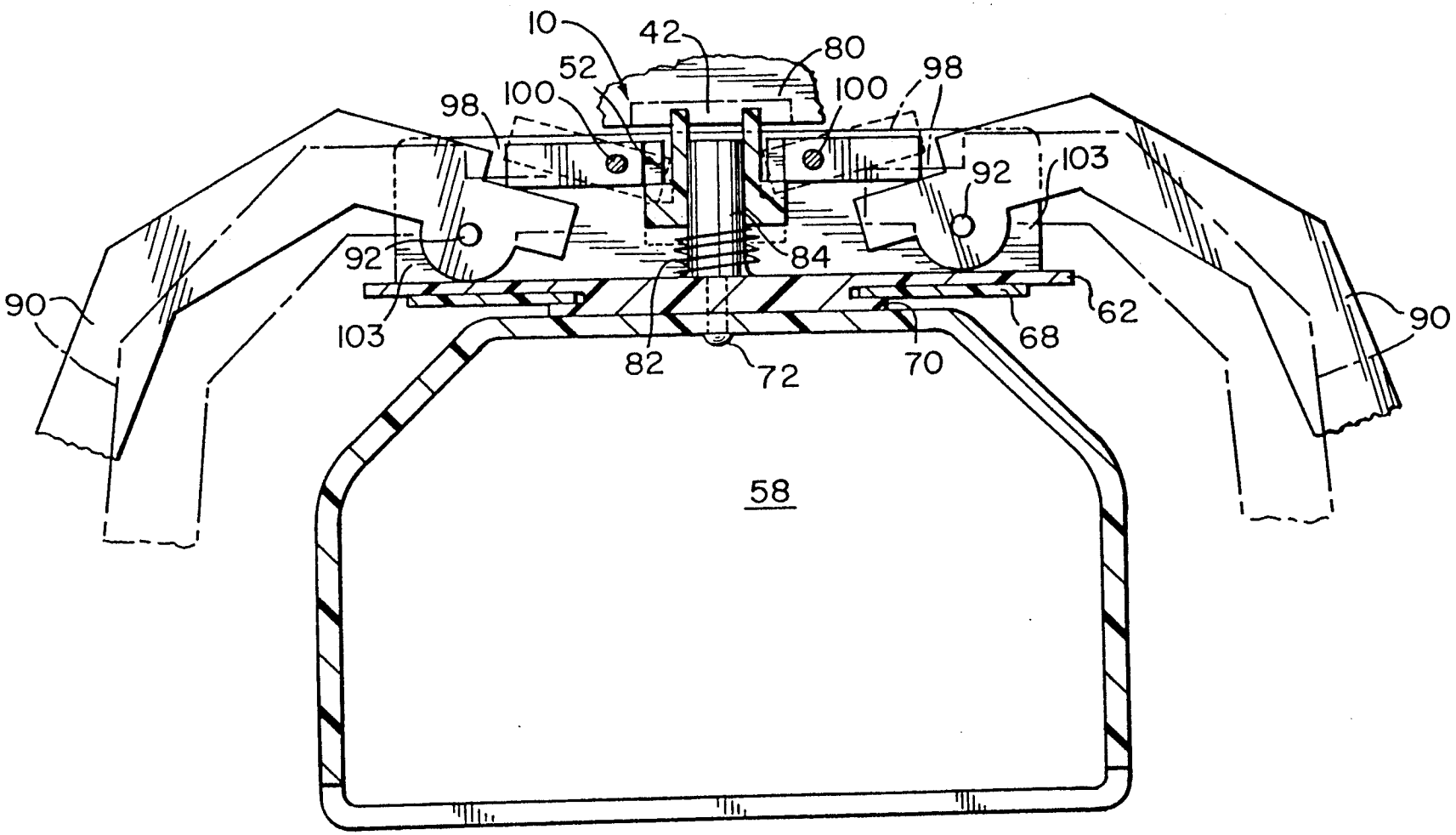
FIG. 3 is a fragmentary sectional view of the launcher taken along the line 3—3 of FIG. 2, with the locking mechanism in its released orientation being illustrated in phantom line.
Figure 4:
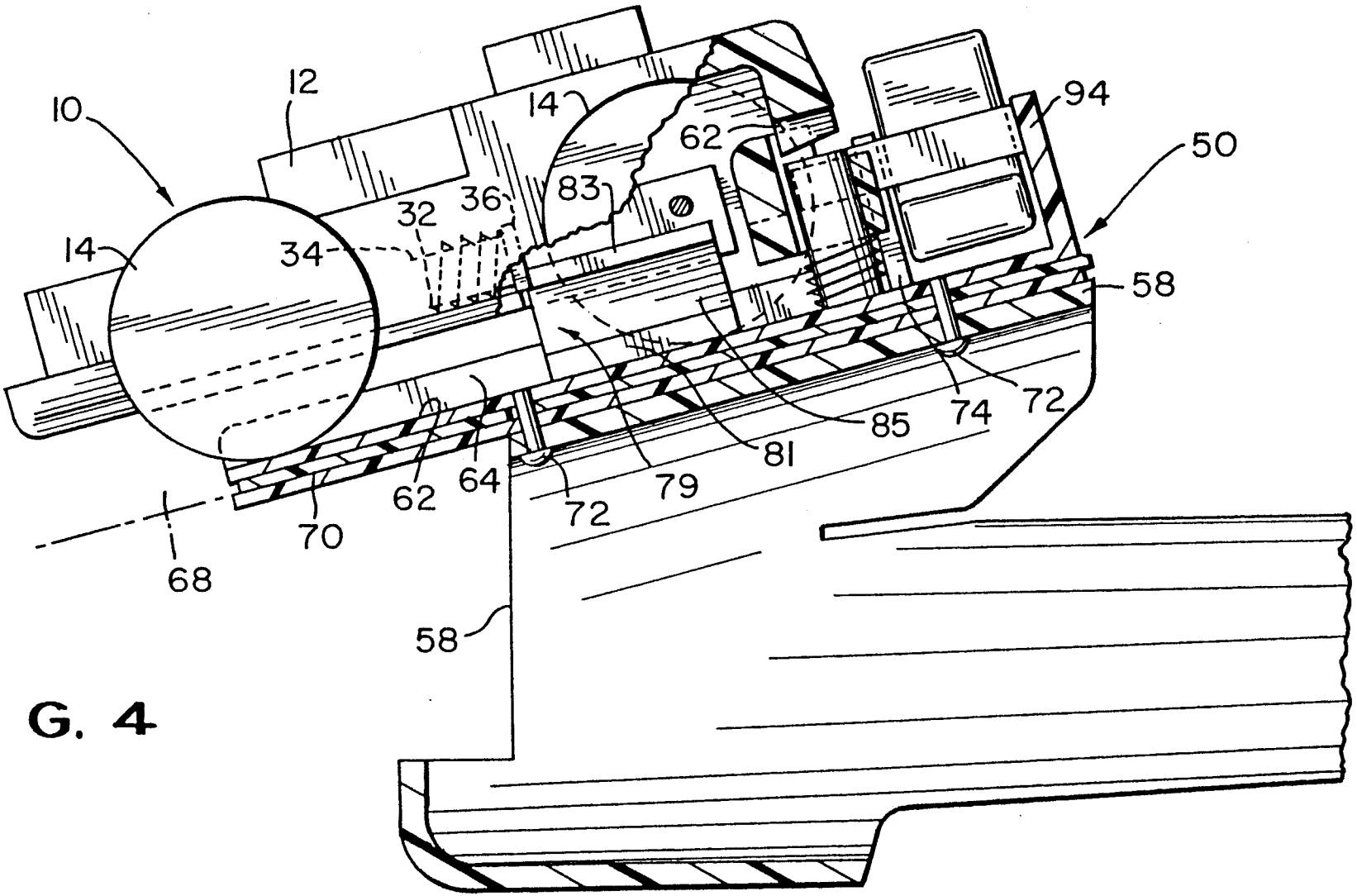
FIG. 4 is a fragmentary side elevational view thereof taken along the line 4—4 of FIG. 2 with a vehicle mounted thereon.

However, the present invention further encompasses a novel launcher for use in conjunction either with the toy vehicle 10 described above or a conventional toy vehicle. Referring now to FIGS. 2–4 in particular, therein illustrated is a launcher according to the present invention, generally designated by the reference numeral 50. The launcher includes a releasable locking means 52 for precluding forward motion of the vehicle mounted thereon, as is conventional in such launchers. However, the launcher 50 of the present invention is configured and dimensioned to be releasably mounted on a human limb so that the longitudinal axis of the vehicle is aligned with the longitudinal axis of the limb. As illustrated in FIGS. 2–4, the limb in question is a foot 56, illustrated in phantom line in FIG. 2. Accordingly, the launcher 50 is configured and dimensioned as the front portion of an open-toed shoe 58 with an elastic strap 60 connecting the two sides of the shoe in back and serving to elastically maintain the shoe 58 on the foot of the user.

Atop the shoe 58 is a launching platform 62 on which the vehicle is to be mounted, with the wheels of the vehicle being disposed outwardly from a pair of raised guides 64 projecting upwardly from the platform 62. Preferably, the platform 62 does not extend all the way from the top of the shoe 58 to the floor or other surface on which the shoe 58 rests. Indeed, if the platform 62 extended that far, it would be difficult to walk with the shoe 58 being worn. Accordingly, the platform 62 is provided with a telescopic extension 68, which in its retracted position is substantially concealed by the platform 62 (as illustrated in FIG. 4), but in its extended position continues the platform 62 almost to the level of the surface on which the shoe 58 is resting (as illustrated in FIG. 2) so that the short drop of the vehicle from the front end of the extended platform extension 68 to the floor does not injure the vehicle. The platform extension 68 is slidably disposed intermediate the platform 62 and a base plate 70, the platform 62, platform extension 68 and base plate 70 being secured atop the shoe 58 by screws 72.

A pair of stops 74 extend upwardly from the platform 62 inwardly of the raised guides 64 to limit the rearward motion of the vehicle 10 as it is mounted on the launcher 50 with a backward motion. Where the launcher 50 is intended for use with a vehicle 10 according to the present invention, a loading bar generally designated 79 is secured to the launcher 50 to engage the piston head 36 and limit rearward motion thereof so that the loading bar 79 causes retraction of the piston head 36 and compression of the spring 32 as the vehicle 10 is being forced backwardly onto the platform 62 by the user. More particularly, the loading bar 79 is an I-shaped beam including a bottom portion 81, a top portion 83, and a transverse (that is, vertical) web portion 85 connecting the bottom and top portions 81, 83. The bottom portion 81 is secured to the platform 62 intermediate the raised guides 64, and the top portion 83 is configured and dimensioned to enter the chassis above slot 40 so as to engage the piston head 36 as the vehicle 10 is moved rearwardly. The connecting web portion 85 between the top and bottom portions 83, 81 is thin enough to enter the slot 40 in the chassis bottom. The loading bar 79 is disposed at least partially in front of the plane of the stops 74 so as to be able to effect the desired loading of the piston 34 before the rearward motion of the vehicle 10 is terminated by the stops 74.

Referring now especially to FIG. 3, the releasable locking mechanism 52 of launcher 50 is of conventional construction and includes a latch 80 which is biased upwardly by a compression spring 82 disposed about a fixed lug 84 so that the latch 80 extends upwardly into the bottom plane of the abutment surface 42 of vehicle 10.

In order to enable release of locking mechanism 52, a lever arm 90 is provided to each side of the shoe 58. Each lever arm 90 is pivotably attached to the rest of the launcher 50 by means of a pin 92 extending between front and rear raised flanges 103, 94 (see FIGS. 2 and 4) of the launcher 50. As the lever arms 90 are moved inwardly and downwardly closer to the sole of shoe 58 (as illustrated by the arrows 96 of FIG. 2), they pivot about the pins 92 and assume a lower and closer orientation (as illustrated in phantom line in FIG. 3). Intermediate each lever 90 and the latch 80 is an intermediate pivotable bar 98 which is pivotable about a pin 100, also extending between the front and rear flanges 103, 94. As the front end of lever arm 90 is moved downwardly and inwardly to its latch-releasing position, the other end of the lever arm 90 causes the intermediate bar 98 to pivot about its pin 100 in the direction of arrow 101 of FIG. 2 (from its solid line orientation to its phantom line orientation in FIG. 3), this action in turn depressing the latch 80 in the direction of arrow 104 against spring 82 until the top plane of the latch 80 descends below the bottom plane of the abutment surface 42 of vehicle 10 and thereby releases the vehicle 10 for forward motion.

To summarize, downward or inward pressure on either lever arm 90 (in the direction of arrow 96) causes the intermediate member 98 associated therewith to pivot (in the direction of arrow 101) so as to cause the latch 80 to move downwardly (in the direction of arrow 104) and thereby release the latching mechanism 52, thus enabling forward motion of the vehicle 10 relative to the launcher 50. This lever arrangement adds to the play value of the toy vehicle and launcher system because the launching mechanism may be released by the user simply moving his foot laterally against a fixed surface such as a wall, or for two players to compete by having two players (each with his or her own toy vehicle and launcher system) press the lever of one system against the lever of the other system so as to obtain a simultaneous release of the vehicles 10. Upon release, the vehicle 10 is propelled by motor 20 or bias means 30 or both downwardly along the axis of the foot, over the toes (phalanges) thereof which presumably had been pointed in the direction desired as the direction of forward motion of the vehicle 10.

The latch 80 has a beveled front and upper surface such that the rearward movement of the vehicle 10 on the launching platform 62 eventually causes the similarly beveled surface 110 of the chassis 12 (see FIG. 1A) to cam the latch 80 downwardly, temporarily, until the abutment surface 42 of the chassis 12 has passed thereover, at which point the latch 80 returns to its normal raised position under the bias of spring 82. During this process, the lever arms 90 move downwardly and inwardly in the direction of arrow 96 to the activated orientation (illustrated in phantom line in FIG. 3), and then return to their original unactivated orientation (illustrated in solid line in FIG. 3) under the influence of spring 82 acting on the lever arms 90 via the latch 80 and intermediate members 98.

Figure 5:
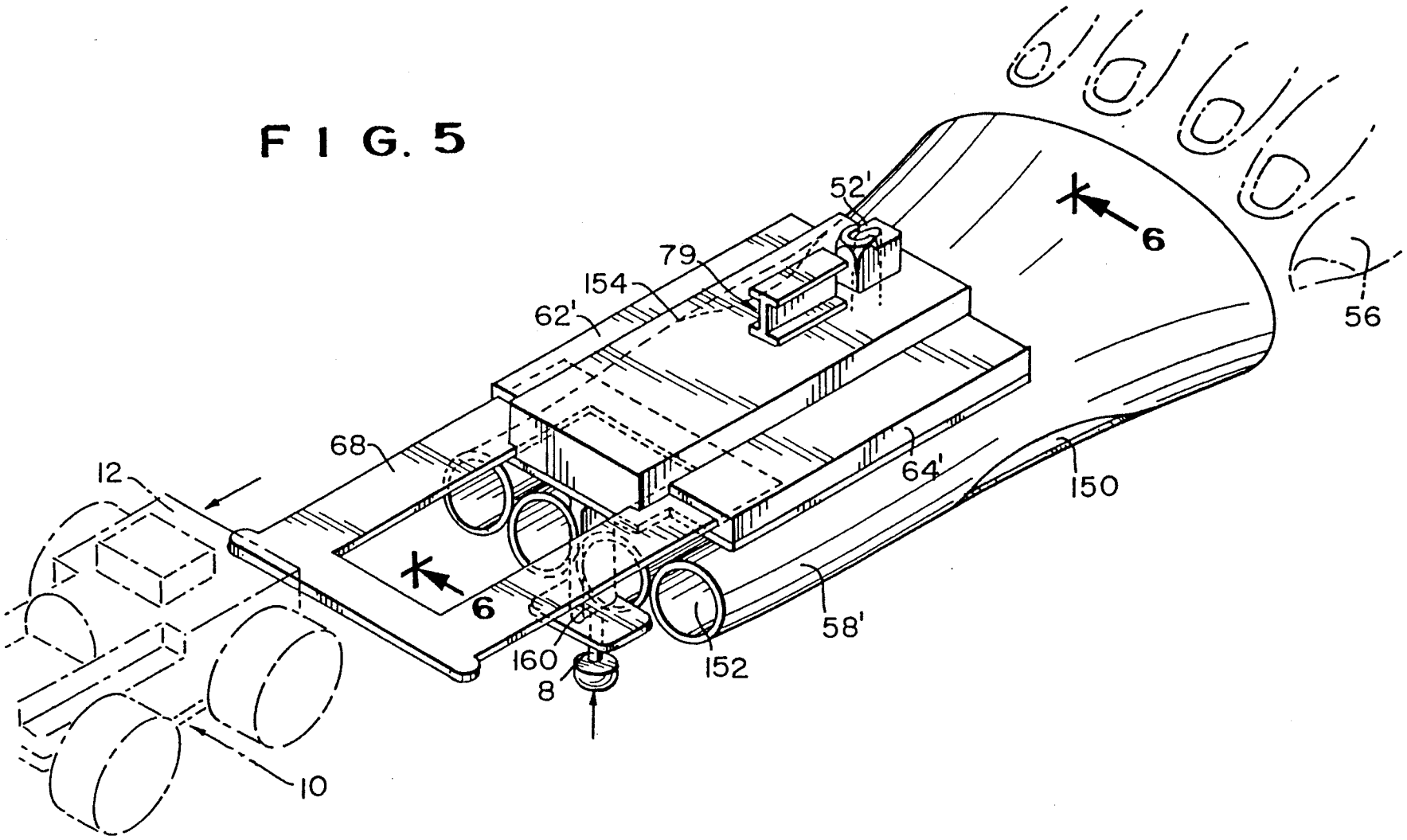
FIG. 5 is an isometric view of a hand-mounted launcher with a vehicle being fragmentarily illustrated in phantom line at the front end thereof and a hand being fragmentarily illustrated in phantom end at the rear end thereof.
Figure 6:
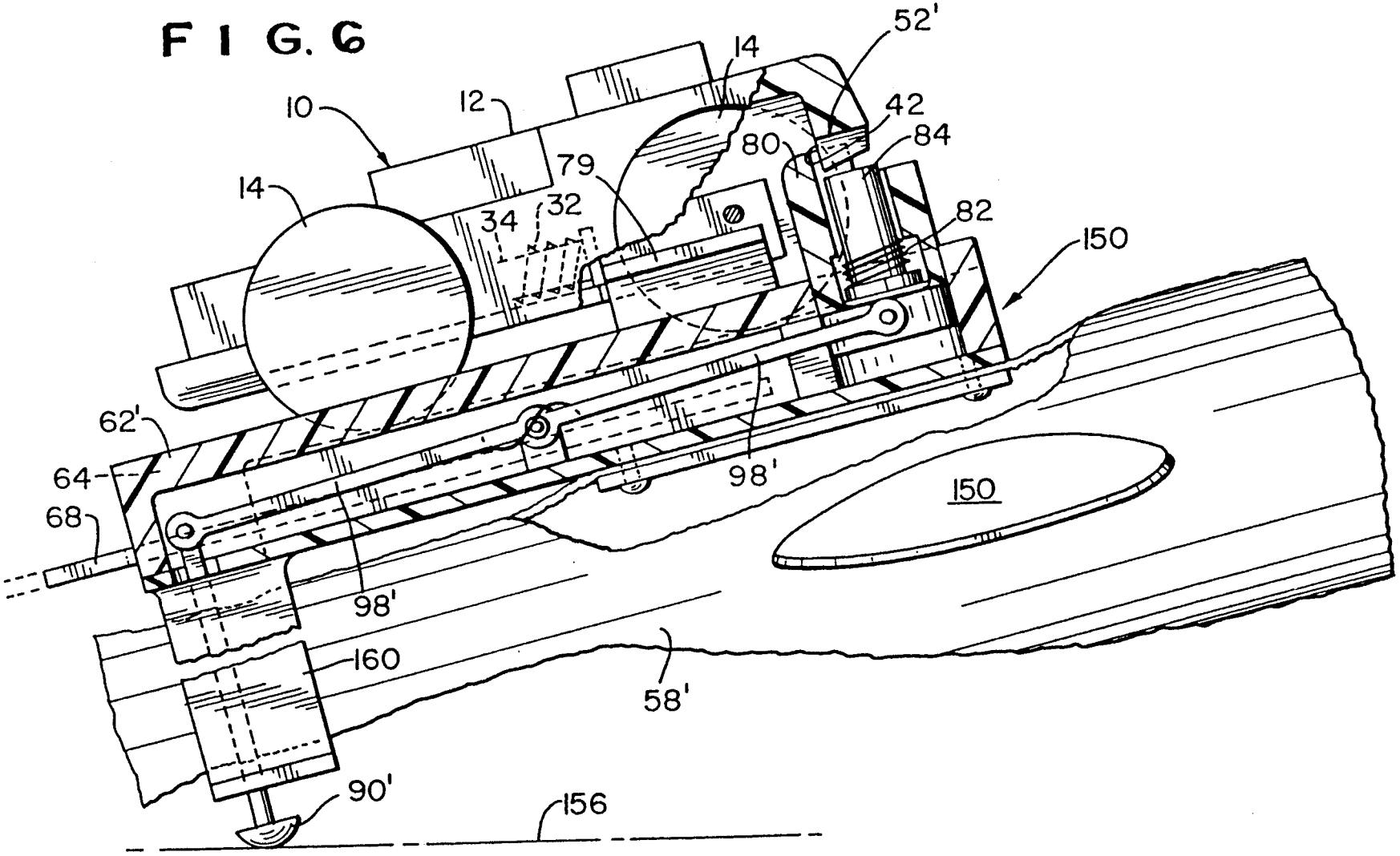
FIG. 6 is a sectional view thereof, taken along the line 6—6 of FIG. 5.

Referring now in particular to FIGS. 5 and 6, therein illustrated is another embodiment 50' of the launcher, which is adapted to be worn on a human hand 56' instead of on a human foot 56. Like numerals will be used for elements of the embodiment 50' which correspond substantially in structure and function to elements of the first embodiment 50, while like numerals primed, will be used for elements which have similar functions to elements of the first embodiment 50 but are structurally different.

The launching platform 62 is mounted on a four-fingered glove 58', rather than on a shoe 58. The glove 58' preferably defines a cut-out 150 on either side thereof configured and dimensioned to enable a thumb of the user to extend therethrough. This permits the glove 58' to be worn on either the right or left hand, as the aperture 150 will accommodate the thumb of either hand. The glove 58' is preferably elastic and provided with cutout fingers 152 for the remaining four fingers so that it will easily accommodate a variety of different size hands 56'. The platform 62' has a central raised portion 154 on which is disposed the loading bar 79 and the locking mechanism 52', the longitudinal sides of the raised portion 154 acting as the raised guides 64'.

The latch 80 is depressed against the bias of spring 82 in order to release the vehicle 10 from the launcher 50' by downwardly depressing the glove portion 58' against a fixed surface 156. A lever arm 90' extends generally vertically downwardly between finger portions 152 of the glove 58' and, acting through a series of articulated lever members 98' disposed within the central raised portion 154 of the platform 62', can depress the latch 80 below the abutment surface 42 of the vehicle chassis 12. As best seen in FIG. 6, a housing 160 extends downwardly from the front of the platform 62' between a pair of finger portions 152 of the glove 58', with lever arm 90' passing through the housing 160 and projecting from the bottom end thereof, in order to protect the lever arm 90' against breakage and reduce any friction between the lever arm 90' and the finger portions 152 of the glove 58' which might interfere with the downward movement of the lever arm 90' under the influence of spring 82 (acting through the latch 80 and the various intermediate lever members 98').

Once the vehicle 10 is loaded on the launcher 50', the user has only to depress his hand against the fixed surface 156 in order to cause an upward movement of lever arm 90', which in turn results in latch 80 moving downwardly below abutment surface 42 in order to release the vehicle 10 from the launcher 50'. As the vehicle 10 travels forwardly along the axis of the fingers (phalanges) of the user's hand 56', the user can accurately aim the vehicle 10 simply by pointing his hand. This enhances the feeling of identification between the user and the vehicle (and thus the driver of the vehicle), and encourages game playing wherein not only the speed of the car and the length of the run, but also the accuracy of the direction of travel may play a role.

The preferred embodiments of the present invention have been described so far in terms of a vehicle 10 having dual means of propulsion (a spring-driven motor 20 and a biasing means 30) and a launcher 50, 50' for use in conjunction either with the vehicle 10 or a conventional toy vehicle. However, the present invention still further encompasses a final embodiment comprising a unique system including a vehicle and a launcher. In this final embodiment the vehicle is a motor-driven vehicle having a wind-up spring-driven motor (similar to motor 20) and, indeed, may be similar to the vehicle 10, either with or without biasing means (similar to biasing means 30). If the vehicle lacks the biasing means, then appropriate analogous biasing means (e.g., a spring and piston) for providing the vehicle with forward motion immediately upon release of the locking means of the launcher are provided on the launcher. Thus in this final embodiment, the launcher may be one of the launchers 50, 50' according to the present invention or, in the instance where the vehicle itself lacks biasing means, such a launcher modified to incorporate analogous biasing means for providing the vehicle with forward motion immediately upon release of the locking means. The launcher of the final embodiment—whether it be a launcher 50, 50' according to the present invention or a conventional launcher (whether modified to provide a biasing means or not)—must mount the vehicle substantially above the running surface on which the vehicle will make its run (for example, the surface 156 of FIG. 6).

Preferably the launcher mounts the vehicle about 0.5–2.0 inches above the running surface so that, upon release of the locking means, the biasing means propels the vehicle forwardly (or even forwardly and partially downwardly towards the running surface). The spacing of the vehicle above the running surface provides an interval of about 0.2 seconds during which the impact of the released biasing means actually causes the vehicle to break contact with the platform or platform extension of the launcher prior to making contact with the running surface. It has been found that even this brief interval is sufficient to allow the motor to at least partially come up to full speed (e.g., about 50% full speed) since the wheels are freely rotatable during this interval while the vehicle is in the air and spaced above the running surface. Thus, instead of the motor slowly coming up to speed due to the frictional resistance between the running surface and the wheels, the temporary disposition of the vehicle wheels spaced above the running surface enables the motor to rapidly come at least partially up to speed. The biasing means (whether within the vehicle or as part of the launcher) and the motor together cooperate so that, upon release of the locking means of the launcher, the biasing means immediately propels the vehicle forward and above the platform extension so that, when the vehicle finally does contact the platform extension or running surface, the motor is already at least partially up to speed. This enables the vehicle not only to attain a long run from the motor, but also a quick start from the motor, thereby to maintain the initial momentum provided by the biasing means.

While the platform extension 68, which connects the platform 62 with the running surface 156, is typically not contacted by the vehicle wheels 14 in the final embodiment, it still serves other functions. The platform extension 68 assists the player in positioning the launcher 50, 50' according to the present invention (or a conventional launcher) at an appropriate distance and angle relative to the running surface 156. Furthermore, in the event that the vehicle is launched at a tilt to one side or the other, the platform extension may assist in straightening out the tilt of the vehicle.

The disposition of the biasing means on the launcher (as opposed to in the vehicle) is desirable because it enables a heavier and thus stronger spring to be used as an element thereof, without adding to the inertia or weight of the vehicle. On the other hand, especially where the launcher is portable, and most especially where the launcher is mounted on a human limb, the disposition of the biasing means in the launcher introduces the risk that a player will use the biasing means to propel a more dangerous article (such as a sharpened pencil) either at himself or someone else. Accordingly, for safety's sake, where the biasing means is disposed in the launcher, care must be taken in selecting the proper strength of the spring, with special attention being paid to the maturity of the prospective players. It has been found that the motor comes up to a substantial fraction of its full speed (generally about 50%) within as short an interval as 0.2 seconds, so that it only necessary for the spring to have sufficient power to maintain the wheels of the vehicle free wheeling above the running surface or platform extension for about that period of time.

This final embodiment is illustrated in FIGS. 2–6 by the combination of the launcher 50, 50' according to the present invention in combination with a vehicle 10 according to the present invention, as the biasing means may be disposed in either the vehicle (as illustrated) or the launcher.

To summarize, the present invention provides a toy vehicle and launcher system which combines the advantages of a wind-up motor and a biasing means to provide a quick start and a long run for the vehicle. More particularly, the present invention provides a toy vehicle having two separate and independent drive means so that it achieves a quick start and a long run. Furthermore, the present invention provides a toy vehicle and launcher system wherein the launcher is mounted on a limb of the user (either the hand or foot) so that the initial forward motion of the vehicle is aligned with the axis of the limb.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A toy vehicle and launcher system comprising:

(A) a motor-driven toy vehicle having a wind-up spring-driven motor to provide forward motion thereof;

(B) a launcher for mounting said vehicle, said launcher having releasable locking means for precluding forward motion of said vehicle; and (C) biasing means, separate and independent from and in addition to said motor, for providing said vehicle with forward motion immediately upon release of said locking means, said biasing means including a spring and a retractable spring-loaded piston; and (D) means for retracting said piston against said spring and for winding said motor as said vehicle is mounted on said launcher with a backward motion.

2. A toy vehicle and launcher system comprising:

(A) a toy vehicle having a body with at least one road contacting wheel and a wind-up spring-driven motor means located within the body and coupled with the at least one wheel so as to be wound up through the wheel for providing said vehicle with forward motion thereof through the wheel when the vehicle is released, and biasing means within the body, separate and independent from and in addition to said motor means, for providing said vehicle with forward motion thereof, said biasing means including a spring and a retractable spring-loaded piston; and (B) a launcher for mounting said vehicle, said launcher having releasable locking means for precluding forward motion of said vehicle, and means for retracting said piston against said spring and winding said motor through said at least one wheel as said vehicle is mounted on said launcher with a backward motion.

3. A toy vehicle and launcher system comprising:

(A) a longitudinally extending toy vehicle; and (B) a launcher for mounting said vehicle, said launcher having a releasable locking means for precluding forward motion of said vehicle, said launcher being selected from the group consisting of glove-like members and shoe-like members and being configured and dimensioned to be releasably mounted on a human limb selected from the group consisting of the hand and the foot so that the longitudinal axis of said vehicle is aligned with the longitudinal axis of the selected limb.

4. The system of claim 1 wherein said locking means is configured and dimensioned for release by movement of the limb.

5. The system of claim 1 wherein said locking means is configured and dimensioned for release by a lateral movement of the limb.

6. The system of claim 1 wherein said locking means is configured and dimensioned for release by a downward movement of the limb.

7. The system of claim 1 wherein said launcher additionally includes means for releasing said locking means, said releasing means extending laterally to both sides of said locking means.

8. The system of claim 1 additionally including a pair of means for releasing said locking means, each of said releasing means being disposed on an opposite side of said locking means and being capable of releasing said locking means independently of the other of said pair of releasing means.

9. The system of claim 1 wherein said vehicle is a motor-driven toy vehicle having a wind-up spring-driven motor to provide forward motion thereof; and the system additionally includes biasing means for providing said vehicle with forward motion immediately upon release of said locking means.

10. The system of claim 1 wherein said biasing means is separate and independent from and in addition to said motor.

11. The system of claim 9 wherein said biasing means is disposed in said vehicle.

12. A toy vehicle and launcher system comprising:

(A) a longitudinally extending toy vehicle; and (B) a launcher for mounting said vehicle, said launcher being configured and dimensioned to be releasably mounted on a human limb selected from the group consisting of the hand and the foot so that the longitudinal axis of said vehicle is aligned with the longitudinal axis of the limb, said launcher having releasable locking means for precluding forward motion of said vehicle and a pair of means for releasing said locking means, each of said releasing means being disposed on an opposite side of said locking means and being capable of releasing said locking means independently of the other of said pair of releasing means.

13. A toy vehicle having two independent and separate means of propulsion in the forwarded direction, one of said propulsion means comprising a wind-up spring-driven motor and the other comprising biasing means, the motor being wound and the biasing means being loaded simultaneously by a single rearward movement of the vehicle.

14. The toy vehicle of claim 13 wherein said biasing means comprises a spring and a retractable spring-loaded piston, the axes of said spring and said piston being longitudinally aligned with the longitudinal axis of said vehicle.

15. The toy vehicle of claim 14 wherein said piston is loaded against said spring by backward motion of said vehicle.

16. The toy vehicle of claim 13 wherein said vehicle comprises at least a longitudinally spaced pair of wheels, and said biasing means is disposed intermediate said pair of wheels.

17. The toy vehicle of claim 13 wherein said biasing means provides said vehicle with a maximum forward motion force essentially immediately upon release of said vehicle from a restrained position, and said motor provides said vehicle with an additional maximum forward motion force thereafter.

18. A toy vehicle having two independent and separate means of propulsion in the forward direction, one of said propulsion means comprising a wind-up spring-driven motor and the other comprising biasing means, said biasing means including a spring and a retractable spring-loaded piston located within the vehicle, the axes of said spring and said piston being longitudinally aligned with the longitudinal axis of said vehicle, said piston being loaded against said spring and said spring-driven motor being wound simultaneously at least by backward motion of said vehicle, whereby said biasing means provides said vehicle with a maximum forward motion force essentially immediately upon release of said vehicle form a restrained position, and said motor provides said vehicle with an additional maximum forward motion force thereafter.

19. A wheeled toy vehicle and launcher system comprising:

(A) a toy vehicle having a body and at least one road contacting wheel supported from the body;

(B) a launcher for mounting said vehicle, said launcher having releasable locking means for precluding forward motion of said vehicle;

(C) biasing means in said body of said vehicle to provide forward motion thereof immediately upon release of said locking means; and (D) a wind-up spring-driven motor in said vehicle body coupled with and wound through the at least one road contacting wheel to provide forward motion thereof after such release.

20. The system of claim 19 wherein said biasing means is separate and independent from and in addition to said motor.

21. The system of claim 19 wherein said biasing means comprises a spring and a retractable spring-loaded piston, said system further including means for retracting said piston against said spring as said vehicle is mounted on said launcher with a backward motion.

22. The system of claim 19 wherein said launcher is configured and dimensioned to be releasably mounted on a human limb so that the longitudinal axis of said vehicle is aligned with the longitudinal axis of the limb.

23. A wheeled toy vehicle and launcher system comprising:

(A) a motor-driven wheeled toy vehicle having a wind-up spring-driven motor coupled with at least one road contacting wheel to wind said motor, said motor and road wheel providing forward motion to said vehicle;

(B) a launcher for mounting said vehicle substantially above a running surface, said launcher having releasable locking means for precluding forward motion of said vehicle; and (C) biasing means disposed in said vehicle for providing said vehicle with forward motion immediately upon release of said locking means and before said vehicle contact the running surface; whereby said motor at least partially comes up to speed before said vehicle contact the running surface.

24. The system of claim 23 wherein said biasing means is separate and independent from and in addition to said motor.

25. The system of claim 23 wherein said biasing means comprises a spring and a retractable spring-loaded piston, said system further including means for retracting said piston against said spring as said vehicle is mounted on said launcher with a backward motion.

26. The system of claim 23 wherein said launcher is configured and dimensioned to be releasably mounted on a human limb so that the longitudinal axis of said vehicle is aligned with the longitudinal axis of the limb.

* * * * *